United States Patent [19]

Persson

[11] Patent Number: 5,039,564

[45] Date of Patent: Aug. 13, 1991

[54] TEARING STRIP, A METHOD OF MANUFACTURING SUCH STRIP AND A PACKAGE PROVIDED WITH THE TEARING STRIP

[75] Inventor: Bengt Persson, Lund, Sweden

[73] Assignee: AB Akerlund & Rausing, Lund, Sweden

[21] Appl. No.: 375,750

[22] Filed: Jul. 5, 1989

[30] Foreign Application Priority Data

Jul. 18, 1988 [SE] Sweden ..... 8802662

[51] Int. Cl.[5] ..... B29D 22/00

[52] U.S. Cl. ..... 428/34.1; 428/349; 428/483; 428/353; 206/605; 206/613; 229/3.1; 156/244.11

[58] Field of Search ..... 428/34.1, 349, 483, 428/353; 206/605, 613; 156/244.11; 229/3.1

*Primary Examiner*—Edith Buffalow

[57] ABSTRACT

A tearing strip of the delaminating type intended for attachment to opposite insides of a package.

The strip has such a layer structure that, relative the inside of the package, it has a melted-together seal while internally the strip has layers which are not fully melted together.

The strip comprises a central, strong layer and a first and second layer arrangement.

The first layer arrangement has a well reproducable, high seal strength relative the central layer. However, the second layer arrangement is "peelable" relative the first layer arrangements or more likely internally between two layers. In contrary the second layer arrangement has a well reproducable, high sealing strength relative the inside of the package.

7 Claims, 2 Drawing Sheets

TEARING STRIP, A METHOD OF MANUFACTURING SUCH STRIP AND A PACKAGE PROVIDED WITH THE TEARING STRIP

FIELD OF THE INVENTION

The present invention relates to packages and more precisely opening devices for such. More precisely the invention relates to a tearing strip, a method of manufacturing such strip and a package provided with the tearing strip.

STATE OF THE ART

There are a great variety of prior art providing opening facilities for packages, flexible packages, cardboard packages, bottles and tubes of plastics or plastics laminate, etc.

So called flexible packages frequently use what is called "peelable layers". The specific characteristics of layers of so to say delaminate at command, which is used for providing opening facilities, frequently is obtained by means of heat sealing of thermoplastic materials of polyolefine type and of such a characteristics that the materials are incompatible in terms of heat sealing. More simplified the materials may be defined as material which do not melt together when heat activated at a certain temperature, but give a certain bond.

As far as pouches of plastics or plastic laminate or polyethylene coated cardboard packages are concerned there are a great number of prior art tearing strips. However, such known strips lack a structure for making the concept commercially useful. This depends on several factors, for instance the previous lack of a basic concept for manufacturing of strips.

One prior art solution of the tearing up problem by using tearing strips utilizes a central polyethyleneterephtalate layer having a primer on both sides thereof and at the outside thereof there are polyethylene layers at both primer layers. The strip is sealed between two opposite inside surfaces of a package, at a pouring opening region thereof, such that a perfect strain resisting seal is obtained between said inside surface and the two polyethylene layers. However, the seal between the primer layers and each adjacent polyethylene layer is made peelable. So, when pulling the strip for tearing up the package at the pouring region thereof, the product inside the package will be exposed to the primer layers or at least residues of such.

Additionally, the creation of a peelable layer, by using primer and reduced heat, and at the time the provision of a perfect full-strength seal between polyethylene/polyethylene is a very difficult task.

OBJECTS OF THE INVENTION

One object of the invention is to eliminate the lack of adequate manufacturing techniques and offer an optimum in terms of production as well as handling.

Additionally, another object is to eliminate all product harmful residues, for instance primer, from the strip and the opening of the package after the strip has been removed.

SUMMARY OF THE INVENTION

The present invention provides a tearing strip, intended to be attached to opposite insides of a package in the region of a pouring opening. The tearing strip has a grip portion protruding from the package and arranged to be gripped for removing the tearing strip, completely or partially, from the package and opening up said pouring opening.

The strip is characterized in that it comprises a central, strong layer and a first and a second layer arrangements at either side of said layer, where the first layer arrangement has a well reproducable, high sealing strength relative the central layer, and the other layer arrangement is "peelable" relative the first layer arrangement or internally between two layers, but has a well reproducable, high sealing strength relative the inside of the package.

In a preferred embodiment the inside of the package, comprises polyethylene or a coating of polyethylene, the central layer comprises a polyethylenetherephtalate layer (PETP), the said first layer arrangement comprises a first polyethylene layer and a primer layer between the polyethylene layer and the polyethyleneterephtalate layer, and the second layer arrangement comprises a second polyethylene layer and a layer X which in terms of heat sealing is incompatible to polyethylene.

Examples of preferred layers X are layers of polypropylene or polyamide.

In another preferred embodiment the central layer has a thickness within the range 20–50 $\mu$m and the rest of the layers of the strip have the following surface weights: Primer layer 0.8 g/m$^2$ TH, the first polyethylene layer 14 g/m$^2$, X-layer 10 g/m$^2$ and the second polyethylene layer 11 g/m$^2$.

In a specifically preferred embodiment the first and the second polyethylene layers and the layer X are coextruded.

The invention also provides a method for manufacturing a tearing strip to be attached to opposite insides of a package in the region for a pouring opening, and which has a grip portion protruding from the package arranged to be gripped for removing the tearing strip, completely or partially, from the package and opening up said pouring opening.

The method is characterized in that a primer is applied on either side of a central, strong layer, and that onto the respective primer coated side there is coextruded polyethylene - X - polyethylene layers, where X is a layer which is incompatible to polyethylene in terms of heat sealing.

However, the invention also relates to a package, the inside or insides of which comprise or are coated by a heat sealable material at least in the region of a pouring opening. The actual package is characterized in that it has a tearing strip according to anyone or any of the accompanying claims 1–5.

DESCRIPTION OF A PREFERRED EMBODIMENT

Figure 1:
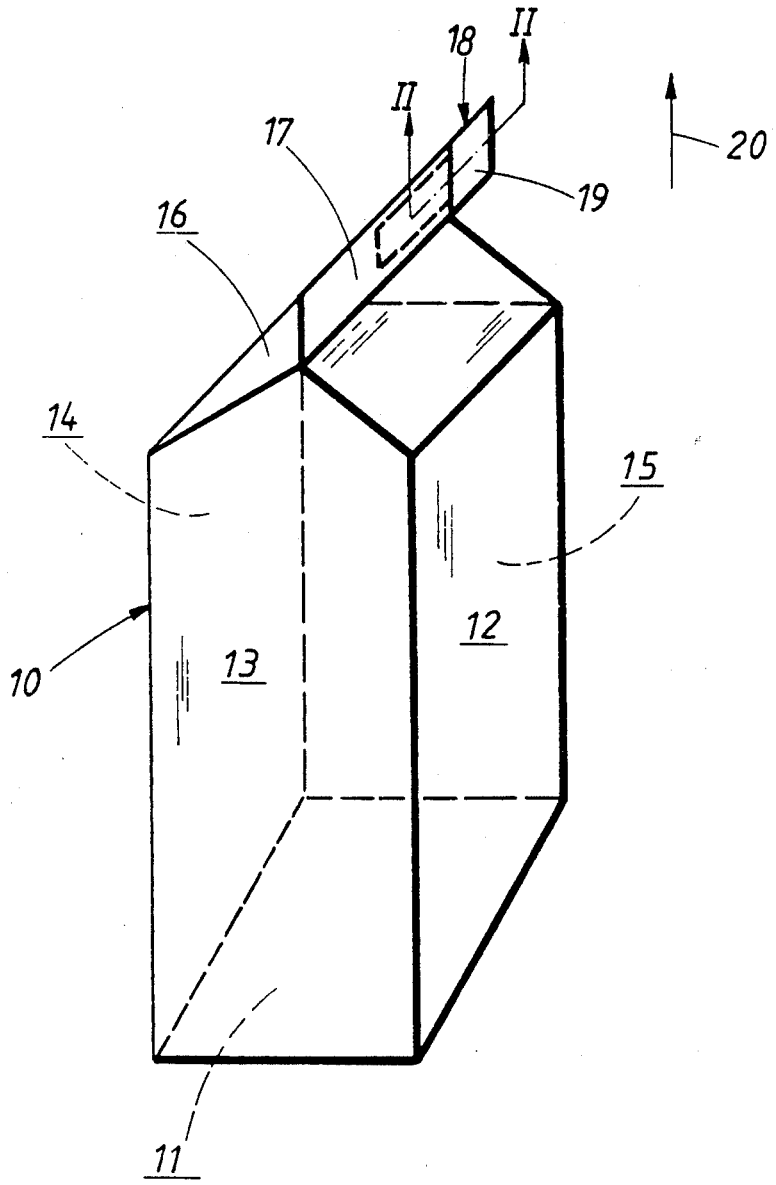
FIG. 1 in a perspective view shows a cardboard package of the "gable top" type having a tearing strip according to the invention.

The package 10 in FIG. 1 is a package of the gable top type manufactured from plastics coated cardboard, where at least the inside of the package is coated by plastics, generally by a coating of polyethylene.

Figure 2:
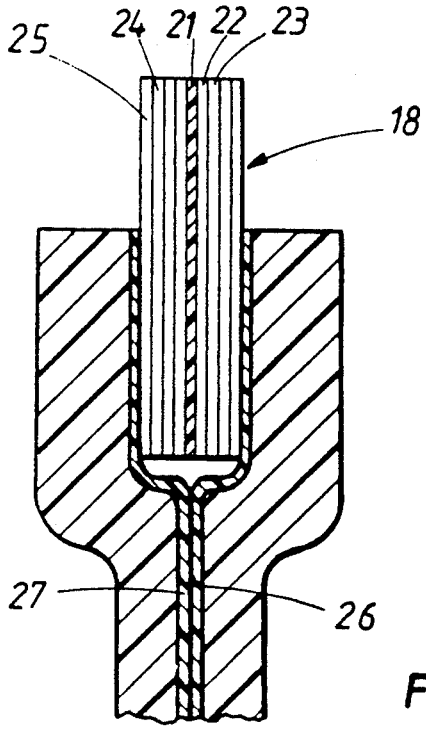
FIG. 2 is a partial section along the cross seal of the package in FIG. 1, FIG. 3 schematically shows, in an exaggerated scale as in FIG. 2, the tearing strip removed from the cross seal.
Figure 3:
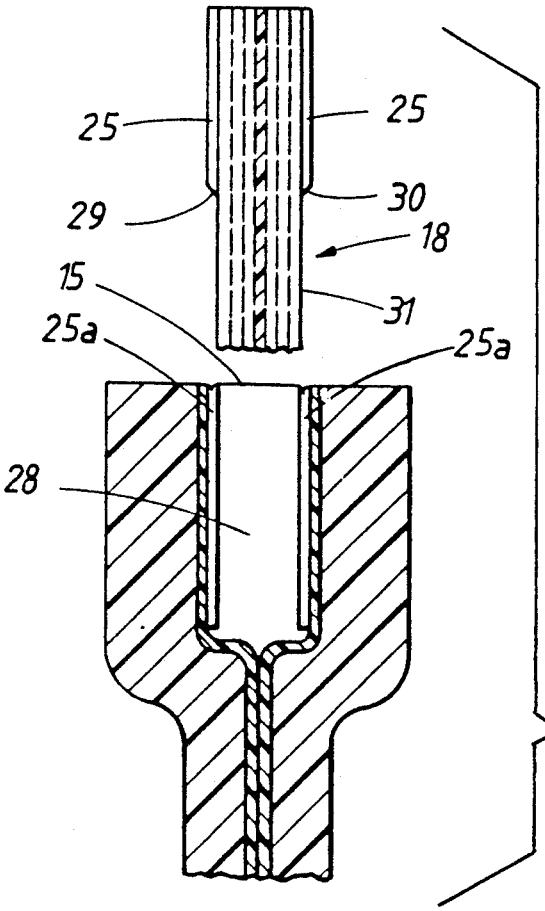

The package 10 may be intended to be used with any type of pourable product, powder, liquid, etc. In a manner known per se the package 10 has a planar bottom closure 11 and the four side walls 12–15 of the package are assembled in a known manner to form a container casing. At the top there is arranged a top closure 16 which is of the so called gable top type and comprises a crosswisely extending seal 17, where the cardboard material is heat sealed, inside against inside along the whole length of the cross seal 17, except the section thereof where the tearing strip 18 according to the invention is inserted. In FIGS. 2 and 3, this tearing strip has been shown with an exaggerated thickness; in practice the heat sealing operation normally used for obtaining a cross seal is not disturbed. The thickening of material possibly caused by the strip is easily compensated by corresponding recesses in the sealing jaws.

The purpose is, that the strip 18 and the outer portion 19 thereof in FIG. 1 inserted in the end seal, should be used for opening up the section thereof where the strip is inserted.

The strip is designed such that a delamination occurs when the strip is gripped at the portion 19 and this portion is pulled in the direction of the arrow 20. The strip delaminates "internally" at such an operation. Thus, it is not the question of a bad seal between the strip and the insides of the packaging materials, but a solution to the sealing problem which does not effect the tightness obtainable by a complete and perfect heat seal along the entire section or length of the crosswise seal or closure 17.

For this specific purpose the strip has a unique structure and comprises basically a central, strong layer 21, in the actual embodiment consisting of a 36 μm thick polyethylenetherephtalate film. Symetrically, at both sides of this central layer 21 there are a first and a second layer arrangements. In the actual case the first layer arrangement comprises two layers, one layer 22 consisting of a primer, and another layer 23 consisting of polyethylene. The adhesion or attachment between the polyethylene layer 23 and the central layer 21 gives a well reproducable, high strength seal. This type of layer structure, as such, is very common in packaging applications and further details thereof are unnecessary in this context.

The so called second layer arrangement according to the present invention does also comprise two layers, one first layer 24, which temporarily may be identified as a layer consisting of the composition X, and a second layer 25 of polyethylene. The material of the layer X is so elected, that when using the heat sealing operation intended for the seal 17, there is obtained, as mentioned, an adequate seal between the polyethylene layers 26, 27 of the packaging material and between the layer 25 and a respective layer 26, 27, however, not between the layer 24 of the material X and the adjacent polyethylene layer 25, 23.

For this purpose the layer 24 in the actual embodiment is a polypropylene layer. In FIG. 3 it is shown how the strip 18 is removed from the crosswise seal 17 and how it has left a pouring opening 28. As mentioned, the strip 18 is externally coated by polyethylene layers 25. Said layers 25 are shown broken through at the tearing up surfaces 29, 30. As previously mentioned, however, the seal between the outer layer 25 of the strip 18 and the polypropylene layer 24 of the strip is of the type "not melted together", meaning that there is a delamination at the boarder surface 31 between each polyethylene layer 25 and the polypropylene layer 24 inside such layer. This delamination effect means that, as soon as the strain in the polyethylene layer 25, i.e. the tearing strain, exceeds the level necessary for tearing up the polyethylene layer and what is needed for delamination, said delamination occurs and leaves portion **25*a*** of the polyethylene outer layer at the inside of the packaging material.

Inside the polyethylene layer 25 there is a polypropylene layer, and this layer is partially exposed when the strip is torn.

It should be observed, that the primer coating or the primer layer never is exposed and thus has no possibility of effecting the contents of the package.

In the embodiment according to FIGS. 1-3, there were obtained especially advantageous opening characteristics when using the following composition of material: a central layer 21 of polyethylenetherephtalate having a thickness of 36 μm, outer polyethylene layers 25 having a surface weight of 11 g/m$^2$, a polyethylene layer 24 having a surface weight of 10 g/m$^2$, inner polyethylene layers 23, 24 having a surface weight of 14 g/m$^2$ and primer having a surface weight of 0.8 g/m TH.

Tests were also made with polyamide and acceptable results were obtained.

The manufacture of the strip was carried out in such a manner that each side of a polyethylenetherephtalate film of the said thickness was coated by a primer, whereafter in an extruder, in successive stations there were coextruded layers of polyethylene - X - polyethylene of said thickness, first on one side of the polyethylenetherephtalate layer and then on the second side.

Although the invention has been described in connection with cardboard packaging, it is realised that the tearing strip is useful also in connection with packages of so called flexible type, i.e. pouches or corresponding of plastics or plastics laminate, as well as packages of tray type, where the strip may be inserted between the closure and the tray to allow simple initiating of the tearing off of the closure by the grip portion thereof and the internal delamination characteristics.

We claim:

1. A tearing strip, intended to be attached to opposite sides of a package in the region of a pouring opening, said tearing strip comprising a grip portion protruding from the package arranged to be gripped for removing the tearing strip, completely or partially, from the package and exposing said pouring opening, said tearing strip comprising a central, strong layer, a pair of first layers on either side of said central layer, the first layer having a well reproducable, high sealing strength relative to the central layer, and a pair of second layers on either side of said pair of first layers, said pair of second layers being peelable relative to said pair of first layaers or internally between two layers, and having a well reproducable, high sealing strength relative to the package.

2. A tearing strip as in claim 1, wherein said tearing strip is intended to be attached to the inside of said package, and said inside of the package comprises polyethylene or a polyethylene coating, the central layer comprises a polyethyleneterephthalate layer, said pair of first layers comprises a first polyethylene layer and a primer layer between said polyethylene layer and said polyethyleneterephthalate layer, and said pair of second layers comprises a second polyethylene layer and an inner layer which, in terms of heat sealing, is incompatible to said polyethylene.

3. A tearing strip as in claim 2, wherein said inner layer comprises polypropylene or polyamide.

4. A tearing strip as in claim 3, wherein the central layer has a thickness of the range 20–50 μm, preferably 35 μm and the remaining layers of the strip have the following surface weights, the primer layer 0.8 $g/m^2$ TH, the first polyethylene layer 14 $g/m^2$, the X layer 10 $g/m^2$, and the second polyethylene layer 11 $g/m^2$.

5. A tearing strip as in claim 1, wherein the first and second polyethylene layers and the layer X form a coextruded structure.

6. A method of manufacturing a tearing strip, intended for attachment to opposite insides of a package in the region of a pouring opening, and which has a grip portion protruding from the package arranged for being gripped to remove the tearing strip, completely or partially, from the package and exposing the said pouring opening, wherein at each side of a central, strong layer (21) there is applied a primer (22), and that on the respective primer coated side there are coextruded polyethylene - X - polyethylene, where X is a layer which is incompatible, in terms of heat sealing, to polyethylene.

7. A package, the inside of which or insides are coated by a heat sealable material, at least in the region of a pouring opening, w h e r e i n the package is provided with a tearing strip according to anyone of claims 1–5.

* * * * *